United States Patent [19]

Bindernagel

[11] 4,094,049

[45] June 13, 1978

[54] CASTING ROLLING MILL FOR WIRE

[75] Inventor: Ali Bindernagel, Wermelskirchen, Germany

[73] Assignee: Friedrich Kocks GmbH, Dusseldorf, Germany

[21] Appl. No.: 716,189

[22] Filed: Aug. 20, 1976

[30] Foreign Application Priority Data

Sep. 6, 1975 Germany ..... 2539697

[51] Int. Cl.[2] ..... B21B 15/00; B23P 19/02; B22D 11/124

[52] U.S. Cl. ..... 29/33 C; 29/33 F; 29/33 S; 29/527.7; 72/184; 164/270; 164/76

[58] Field of Search ..... 164/76, 263, 270; 29/33 C, 527.6, 527.7; 72/184

[56] References Cited

U.S. PATENT DOCUMENTS

| | | | |
|---|---|---|---|
| 334,454 | 1/1886 | Morgan | 164/270 X |
| 2,827,944 | 3/1958 | Grossu | 29/33 C X |
| 3,146,525 | 9/1964 | Bongiovanni | 164/76 |
| 3,392,775 | 7/1968 | Lotz | 164/263 X |
| 3,791,258 | 2/1974 | Krall et al. | 29/33 C X |

*Primary Examiner*—Othell M. Simpson
*Attorney, Agent, or Firm*—Buell, Blenko & Ziesenheim

[57] ABSTRACT

A rolling mill structure is provided especially for wire and like products having a continuously operating casting unit providing a cast metal strand and a rolling mill receiving the strand, the rolling mill being installed on a sliding carriage that is capable of moving in and counter to the direction of rolling at a velocity ($V_W$) between zero and approximately the maximum velocity ($V_G$) of the casting strand emerging from the casting arrangement.

5 Claims, 6 Drawing Figures

Figure 1:
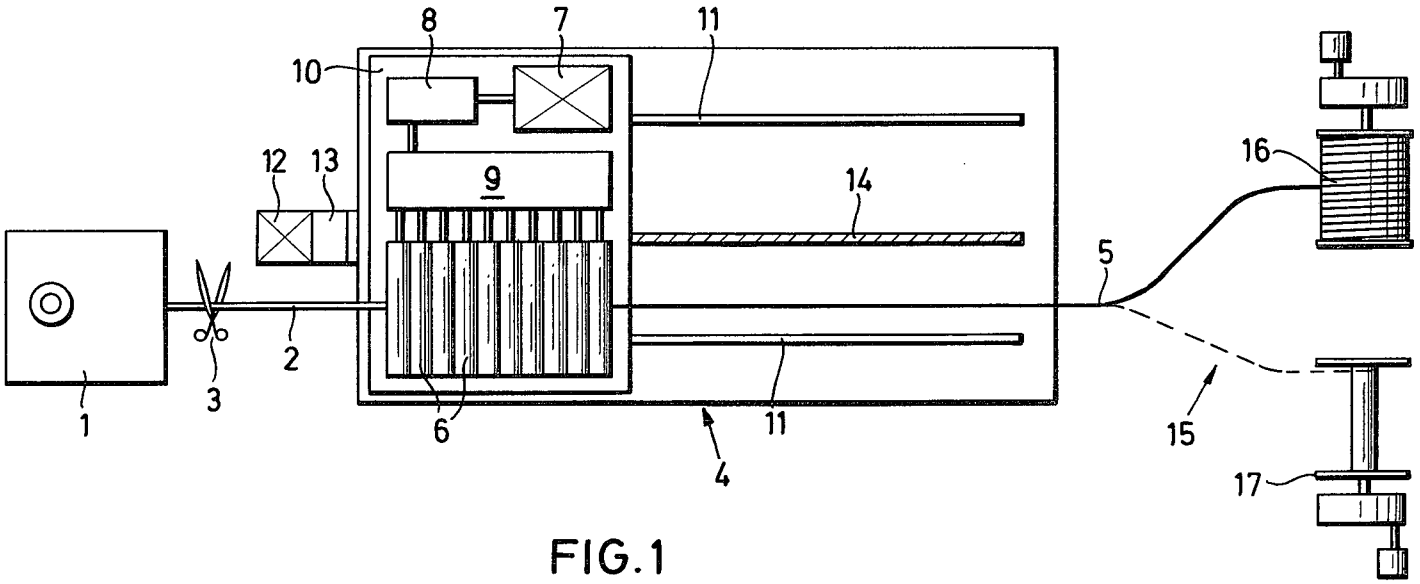

$v_{e1}$
$v_{e2} < v_{e1}$
$v_G$
$v_W = 0$
$v_W = v_G$
$v_W < v_G$
$v_W \ll v_G$
1
2
3
4
5
6
10
12
13
16
17
18

CASTING ROLLING MILL FOR WIRE

The invention concerns a casting rolling mill or plant for wire, especially for nonferrous metals, with a continuously operating casting arrangement, at least one multi-stand separate roll line beyond it, and an arrangement for coiling the wire.

In a familiar installation of this type the casting arrangement has a casting wheel, such that the material acquires a curved shape during casting. Therefore, it must be restraightened before it passes into the subsequent rolling mill. This familiar construction type has the disadvantage that a number of materials cannot be processed because it is impossible with this type of equipment to run the casting strand straight if it is not uniformly solidified over its entire cross section. Unacceptable defects arise in the material thereby formed, which cannot be eliminated, even in the subsequent processing. For this reason, casting arrangements have already been developed, in which the melt is cast in an essentially straight manner and the casting strand then becomes curved only slightly or not at all on its way to the next rolling mill.

Such casting arrangements should operate as continuously as possible because any stoppage and, in particular, readvance involve considerable expense. Thus, a casting strand emerges continuously from such plants at an essentially constant rate and it must be just as continuously processed by the subsequent equipment. This is no problem for the subsequent separate roll lines, but beyond these difficulties arise in coiling the finished wire. The wire leaves the rolling mill at a substantial rate on account of the cross-section reduction and stretching, and the problem of coiling the finished wire directly on a spool at such a high emergence speed has not yet been reliably solved. The difficulties arise at the beginning of the coiling process because it has not yet been possible always to catch the end of the wire reliably at the high emergence speed and hold it fast on a spool. Therefore, in the familiar casting rolling plants it is either impossible to utilize spools or the plant must be operated uneconomically slowly, which then leads to further difficulties, especially in the rolling mill.

In practice, either reel arrangements in which the wire is conducted into reel baskets with the aid of a laying tube or spoolers are used in such casting rolling plants for coiling the wire. These reeling arrangements have the essential disadvantage that the wire must be fed into a laying tube, in which it can acquire surface scratches. The spoolers have the disadvantage that they no longer catch the end of the wire reliably at rolling speeds above ca. 25 m/sec. The capacity of such plants is thus limited. Moreover, when reeling baskets are used, the bundles obtained are coiled relatively loosely and require a comparatively large amount of space per unit of wire weight. This is disadvantageous in the transport and storage of the wire, and consequently, such wire bundles are subsequently coiled on spools, which requires additional work and equipment. Therefore, attempts have always been made to coil the wire directly on spools, but this has not been possible in casting rolling plants that operate continuously and at a high emergence speed for the above reasons. To be sure, attempts have been made to solve this problem by the formation of reserve loops, but this is not possible in many cases in front of the rolling mill due to the type of material, nor can it be carried out beyond the rolling mill due to the high emergence speed. Thus, sufficient time cannot be provided for changing the spools, i.e., the time required for cutting the wire, conveying it to a new spool, clamping the end of the wire fast, and accelerating the spool to the normal operating r.p.m. Therefore, reeling arrangements have been used to date, but they are capable of effecting only loose wire bundles and rolling speeds of no more than 25 meters/second can be achieved.

The purpose of the invention is to provide a casting rolling plant unencumbered by the above disadvantages, is suitable for all the materials involved, and operates more efficiently and economically than the familiar construction types.

This task is resolved in accordance with the invention by providing a separating arrangement between the casting unit and the separate roll line and that the separate roll line with its drive is installed on a sliding carriage that is capable of moving in and counter to the direction of rolling at a speed between zero and approximately the maximum rate of advance of the casting strand emerging from the casting arrangement.

It is thus advantageously achieved that there is a short pause at the beginning of a new coiling process in the wire coiling arrangement, during which no rolled wire is arriving, even though the casting unit continues to operate continuously. This pause is sufficiently long to replace a full spool with an empty one and/or adjust the wire conveying mechanism on an empty spool. In addition, the new coiling process can begin slowly in this manner, such that it is possible to catch the end of the wire securely, clamp it fast on the spool, and accelerate the latter to its operating r.p.m. Thus, the time required for the use of spools can be provided with the design according to the invention in the wire coiling arrangement. As a result, the wire emerging from the rolling mill can be advantageously coiled directly on a spool, and the subsequent recoiling of a bundle on a spool is eliminated. Furthermore, the rolling speed can be substantially increased because no reels with their laying tubes are required and the end of the wire is securely clamped on the spool. A higher rolling speed is synonymous with greater efficiency of the plant and a greater economy, due to the fact that the wire is coiled directly on a spool. The casting strand does not need to be bent into a reserve loop; consequently, even sensitive material can be processed in a plant according to the invention. It is thus advantageously possible to use a spool directly without bending the casting strand or the wire into a loop, and the results are a higher rolling speed and a space-saving coiling of the wire.

It is recommended in accordance with the invention to separate the casting strand emerging from the casting unit at the end of a coiling process and to run the separate roll line in the direction of the coiling arrangement at approximately the speed of casting strand advance, with the rolls continuing to run at their normal speed, to slow the rate of advance of the separate roll line below that of the casting strand down to zero at the beginning of the subsequent coiling process, and return the separate roll line to its original position at an elevated rolling rate and with a low advance rate up to the casting arrangement.

Although the use of reels for coiling the wire is also basically possible in the design according to the invention, it is recommended to install a spool arrangement for coiling the wire on spools beyond the separate roll line. It is expedient here if the spool arrangement in a familiar manner permits a rapid change of the arriving wire to another spool and a rapid replacement of the spools.

The invention is illustrated in the drawing by means of an implementation example.

FIG. 1 schematically presents a plan view of a casting rolling plant according to the invention.

FIGS. 2 – 6 shows the plant according to FIG. 1 in side view in various operating positions.

In FIG. 1 a casting arrangement 1 produces a casting strand 2, which emerges continuously from it. The casting arrangement 1 can be any one of the familiar casting arrangements; consequently, it is represented quite generally only by a rectangular box.

A separating arrangement 3 is provided at only a short distance beyond the casting arrangement 1; it consists of a flying shears or saws of the familiar type. Other familiar separating arrangements may also be used. Consequently, only the symbol of a shears was used here for this separating arrangement and it stands for all these familiar separating arrangements.

A separate roll line 4 is provided beyond the shears 3, in which the casting strand 2 is rolled out into a relatively thin wire 5. This shaping process takes place in a number of roll stands 6, the rolls of which are driven by a motor 7 through a reduction gear 8 and a distributor gear 9. Naturally, the rolling mill can also be driven by several motors. The rolling mill, consisting of the roll stands 6 and their drive 7, 8 and 9, is arranged on a sliding carriage 10 capable of moving in and counter to the direction of rolling, i.e. reciprocating in the direction of rolling. The sliding carriage 10 slides on the guides 11 and its longitudinal movements are effected by a motor 12 which drives a worm-gear spindle through a gear unit 13. Of course, there are also other possibilities for driving the sliding carriage 10, e.g., rack-and pinion drive, a drawing drive by chain, cable, etc., or with a working cylinder.

An arrangement for coiling the wire is indicated and designated by 15 beyond the separate roll line 4. It consists of two spools 16 and 17, the first of which is almost completely filled with wire 5 in FIG. 1, while spool 17 is still empty and the path of the wire 5 is indicated only by a dashed line.

Figures 2, 3, 4, 5, 6:
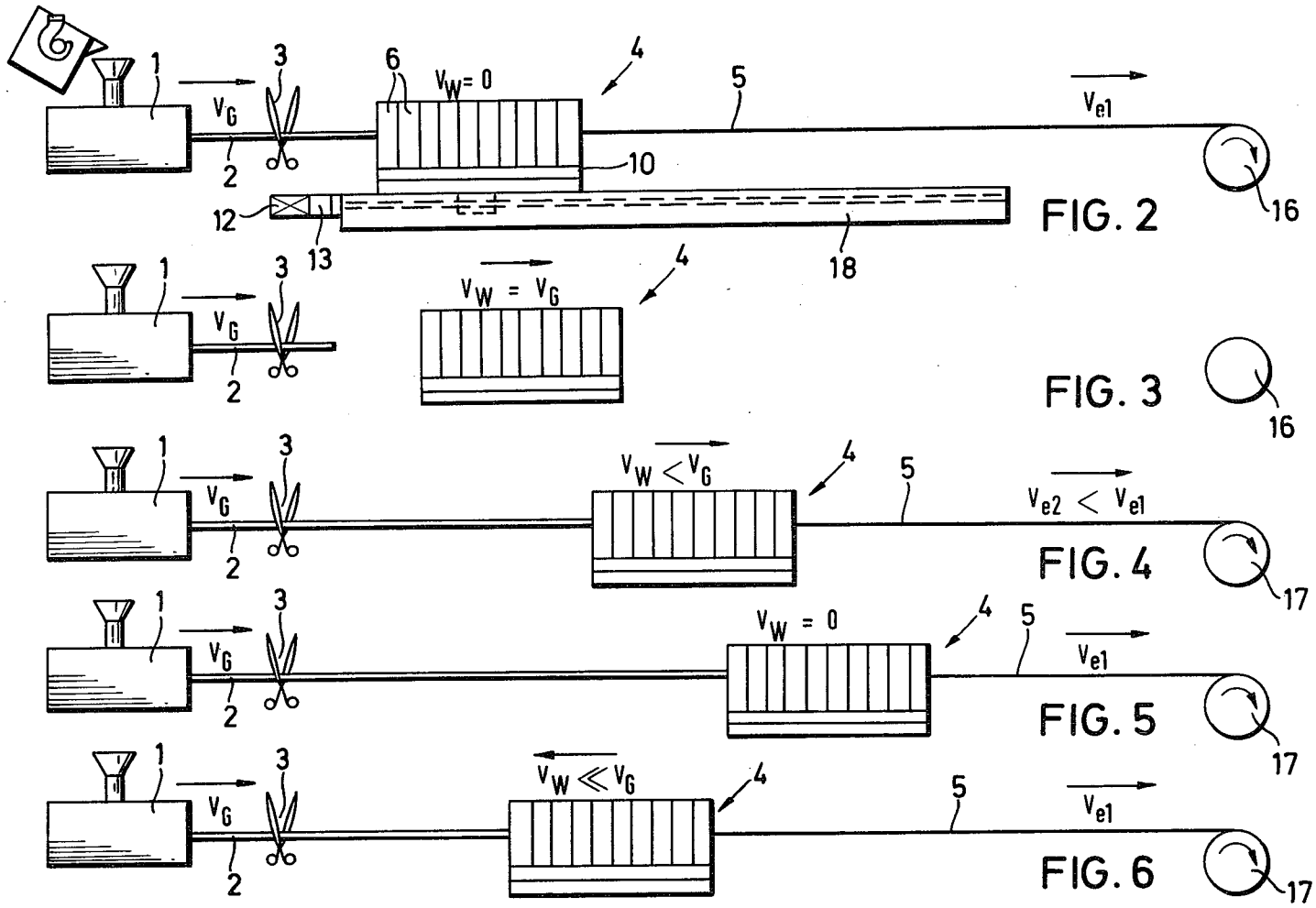

In FIG. 2 the separate roll line 4 is in its original position near the casting arrangement 1 and the separating arrangement 3. It rests on the beam designated by 18 and does not move during the operating phase shown in FIG. 2. The casting strand 2 emerges from the casting unit at a velocity $V_G$ and passes through the stationary separating unit 3 into the roll stands 6. The wire 5 that results there leaves the roll stands 6 at a velocity $V_{e1}$, at which it is taken up by the spool 16. This is the situation during the longest time interval, i.e., until shortly before the complete filling of spool 16.

When spool 16 becomes full, the casting strand 2 is cut by the separating unit 3 and at the same time the separate roll line 4 moves up to spool 16, precisely at the velocity $V_G$ with which the casting strand 2 continues to emerge from the casting unit 1. By moving the separate roll line 4 toward spool 16 at the velocity $V_G$, no new material can pass into the separate roll line 4. However, because the roll stands 6 continue to be driven at a normal, or perhaps a somewhat increased r.p.m. and the wire 5 leaves the rolling mill 4 at a velocity of at least $V_{e1}$, which is considerably higher than the velocity $V_W$, the roll mill 4 is run empty after a short time and the end section of wire 5 is coiled up by spool 16. This situation is portrayed in FIG. 3.

As soon as the end of the wire is coiled up by spool 16, the latter is replaced by the empty spool 17. There is also the possiblity, indicated in FIG. 1, of directing the wire 5 to the empty spool 17 via the guide mechanism. However, this wire can engage the next spool 17 only if the rate of advance $V_W$ of the rolling mill 4 is less than the emergence velocity $V_G$ of the casting strand 2 from the casting unit 1. The forward movement of the rolling mill 4 toward spool 17 is chosen however to be only slightly less than the emergence velocity $V_G$ of the casting strand 2, such that a very low emergence velocity $V_{e2}$ of the wire 5 from the moving rolling mill 4 results. At this low velocity $V_{e2}$, at which the wire 5 moves toward spool 17, the end of the wire can be easily engaged and clamped fast. This situation is portrayed in FIG. 4.

As soon as the end of the wire 5 is clamped fast on spool 17, the latter is accelerated to its normal working r.p.m. and at the same time the rolling mill 4 is braked to a stop in its forward movement $V_W$. The result of this is that the casting strand 2 runs into the rolling mill 4 at its full advance velocity $V_G$ and the rolls, which then turn at their normal operating r.p.m.'s, assure that the wire leaves the rolling mill at its original emergence velocity $V_{e1}$. The wire is coiled up by spool 17, which in the meantime has reached its full operating r.p.m. This situation is portrayed in FIG. 5 and it essentially corresponds to the situation in FIG. 2, except that the rolling mill 4 has in the meantime reached its right-hand final position.

FIG. 6 shows that the rolling mill 4 moves back from its right-hand final position to its left-hand original position. However, this takes place quite slowly. A higher speed is not necessary because a relatively long period of time is available for the return movement of the rolling mill, i.e., the time required for spool 17 to become filled. In order to allow for the emergence velocity $V_G$ of the casting strand and to maintain the emergence velocity $V_{e1}$ of the wire 5, the drive 7, 8 and 9 of the roll stands 6 runs somewhat more rapidly than during the other operating phases of the installation, but only at a rate corresponding to the return movement of rolling mill 4 to its original position according to FIG. 2. The rolling mill 4 remains in that position until spool 17 is almost filled, when the entire process is repeated.

In the foregoing specification I have set out certain preferred practices and embodiments of this invention, however, it will be understood that this invention may be otherwise embodied within the scope of the following claims.

I claim:

1. A continuous casting and rolling plant for wire, particularly non-ferrous wire, comprising a continuous casting unit continuously casting a strand of metal to be formed, replaceable coiling means spaced from the casting unit, a rolling means intermediate the casting unit and coiling means having a roll pass line receiving said strand for conversion to wire, said rolling unit being movable selectively from a position adjacent said casting unit to a position adjacent said coiling unit and back to the position adjacent the casting unit, means adjacent the casting unit for selectively severing the strand, means acting on the rolling unit each time the strand is cut moving said rolling unit toward the coiling means at substantially the rate of advance of the cast strand with the rolling unit operating at normal operating speed, means for replacing the coiling means each time a coil is completed, means for attaching a wire end from the rolling unit to the coil means and means for reversing the rolling unit to move it back to a position adjacent the casting unit with the strand continuing to pass through the roll pass line for conversion to wire.

2. An apparatus as claimed in claim 1 wherein the means acting on the carriage is capable of moving the carriage reciprocally in the line of strand casting at a velocity $V_W$ between zero and the maximum velocity $V_G$ of the casting strand emerging from the casting unit.

3. A continuous casting and rolling plant for wire as claimed in claim 1 wherein the coiling means is a pair of interchangeable spools shiftable into and out of alignment with the pass line.

4. The method of continuous casting and rolling of wire, particularly nonferrous wire, comprising the steps of:

a. continuously casting a strand of metal to be formed,
b. delivering the continuously cast strand into a rolling unit capable of converting said strand to wire,
c. rolling said strand into wire in said mill,
d. coiling said wire on a replaceable coiling means spaced from the rolling unit,
e. severing the strand ahead of the rolling unit when the coiling means is filled,
f. moving the rolling unit toward the coiling means at about the rate of advance of the casting strand with the rolling unit continuing to operate at normal speed until the severed strand is formed into wire and coiled,
g. replacing the coiling means,
h. permitting the strand end to enter the rolling unit to start a new length of wire,
i. attaching wire to the coiling means,
j. stopping the movement of the rolling unit toward the coiling means, and
k. reversing the movement of the rolling unit to return it to its original position.

5. The method as claimed in claim 4 wherein the roll unit is proportionally increased in rolling speed during return to its normal position.

* * * * *